US009383670B2

(12) United States Patent
Tsujihiro et al.

(10) Patent No.: US 9,383,670 B2
(45) **Date of Patent: *Jul. 5, 2016**

(54) TONER AND METHOD FOR MANUFACTURING THE SAME

(71) Applicant: KYOCERA Document Solutions Inc., Osaka (JP)

(72) Inventors: Masami Tsujihiro, Osaka (JP); Ryotaro Komada, Osaka (JP)

(73) Assignee: KYOCERA Document Solutions Inc., Osaka (JP)

( * ) Notice: Subject to any disclaimer, the term of this patent is extended or adjusted under 35 U.S.C. 154(b) by 0 days.

This patent is subject to a terminal disclaimer.

(21) Appl. No.: 14/521,604

(22) Filed: Oct. 23, 2014

(65) Prior Publication Data

US 2015/0118615 A1 Apr. 30, 2015

(30) Foreign Application Priority Data

Oct. 29, 2013 (JP) ..... 2013-224525

(51) Int. Cl.
*G03G 9/093* (2006.01)

(52) U.S. Cl.
CPC ..... *G03G 9/093* (2013.01); *G03G 9/0935* (2013.01); *G03G 9/09307* (2013.01); *G03G 9/09392* (2013.01)

(58) Field of Classification Search
CPC ..... G03G 9/09307
See application file for complete search history.

(56) References Cited

U.S. PATENT DOCUMENTS

| | | | | |
|---|---|---|---|---|
| 4,968,577 | A * | 11/1990 | Kohri | G03G 9/0825 428/402.21 |
| 4,973,541 | A * | 11/1990 | Kohri | G03G 9/093 428/402.21 |
| 5,225,308 | A * | 7/1993 | Sasaki | G03G 9/09328 430/110.2 |
| 5,302,486 | A * | 4/1994 | Patel | G03G 9/09321 430/110.2 |
| 9,188,894 | B2 | 11/2015 | Ida et al. | |
| 2005/0271964 | A1 | 12/2005 | Etou et al. | |
| 2008/0057434 | A1 * | 3/2008 | Itoh | G03G 9/0806 430/137.15 |
| 2015/0037717 | A1 | 2/2015 | Ida et al. | |

FOREIGN PATENT DOCUMENTS

| | | | |
|---|---|---|---|
| JP | 2004-294469 | A | 10/2004 |
| JP | 2007-063550 | A | 3/2007 |
| JP | 2013-092767 | A | 5/2013 |

* cited by examiner

*Primary Examiner* — Hoa V Le
(74) *Attorney, Agent, or Firm* — Studebaker & Brackett PC

(57) ABSTRACT

A toner includes a plurality of toner particles each having a core and a shell layer on a surface of the core. In a cross section of the toner particle analyzed by EELS, for at least 50% of a circumferential length of the core, the shell layer has one or more portions each satisfying conditions that: a ratio of INc to INs is no less than 0.0 and no greater than 0.2; and a thickness of the shell layer is at least 5 nm. Here, INs indicates an intensity of an N-K shell absorption-edge originating from nitrogen atoms in the shell layer, and INc indicates an intensity of an N-K shell absorption-edge originating from nitrogen atoms in the core. In addition, the longest length among the one or more portions of the shell layer each satisfying the conditions is at least 100 nm.

3 Claims, 10 Drawing Sheets

| Item number | X coordinate | Y coordinate | Density |
|---|---|---|---|
| 1 | 31 | 151 | 22.4 |
| 2 | 103 | 134 | 6.7 |
| 3 | 165 | 104 | 13.7 |
| 4 | 194 | 150 | 2.7 |
| 5 | 256 | 146 | 9.4 |
| 6 | 318 | 128 | 8.6 |
| 7 | 341 | 154 | 12.5 |
| 8 | 442 | 162 | 3.9 |
| 9 | 457 | 113 | 31.0 |
| 10 | 410 | 128 | 13.7 |
| 11 | 253 | 119 | 1.2 |
| 12 | 146 | 174 | 5.1 |
| 13 | 91 | 163 | 8.2 |
| 14 | 72 | 121 | 5.5 |
| 15 | 52 | 166 | 1.2 |
| 16 | 72 | 140 | 14.9 |
| 17 | 146 | 148 | 7.5 |
| 18 | 138 | 120 | 0.0 |
| 19 | 175 | 124 | 2.7 |
| 20 | 212 | 119 | 0.0 |
| 21 | 217 | 168 | 7.5 |
| 22 | 274 | 171 | 1.6 |
| 23 | 299 | 142 | 9.0 |
| 24 | 316 | 176 | 1.2 |
| 25 | 396 | 175 | 6.7 |
| 26 | 380 | 149 | 7.8 |
| 27 | 369 | 120 | 1.2 |
| 28 | 429 | 144 | 9.4 |
| 29 | 463 | 170 | 0.4 |
| 30 | 475 | 142 | 4.3 |
| 31 | 227 | 136 | 0.8 |
| ⋮ | ⋮ | ⋮ | ⋮ |

| Item number | X coordinate | Y coordinate | Density |
|---|---|---|---|
| ⋮ | ⋮ | ⋮ | ⋮ |
| 72 | 349 | 101 | 16.9 |
| 73 | 297 | 109 | 0.4 |
| 74 | 303 | 121 | 14.5 |
| 75 | 273 | 115 | 5.1 |
| 76 | 243 | 111 | 3.5 |
| 77 | 241 | 144 | 3.5 |
| 78 | 193 | 107 | 1.6 |
| 79 | 419 | 159 | 4.3 |
| 80 | 419 | 184 | 2.4 |
| 81 | 397 | 151 | 0.4 |
| 82 | 375 | 172 | 0.4 |
| 83 | 454 | 141 | 2.7 |
| 84 | 453 | 178 | 3.9 |
| 85 | 454 | 155 | 0.4 |
| 86 | 434 | 122 | 10.6 |
| 87 | 474 | 113 | 14.1 |
| 88 | 435 | 102 | 14.1 |
| 89 | 239 | 154 | 0.0 |
| 90 | 275 | 185 | 8.6 |
| 91 | 139 | 184 | 4.3 |
| 92 | 104 | 186 | 0.4 |
| 93 | 93 | 178 | 1.2 |
| 94 | 122 | 124 | 13.3 |
| 95 | 134 | 133 | 12.5 |
| 96 | 105 | 145 | 16.5 |
| 97 | 111 | 157 | 4.3 |
| 98 | 9 | 152 | 0.8 |
| 99 | 9 | 165 | 0.0 |
| 100 | 50 | 140 | 3.5 |
| | | Average value | 6.82 |

FIG. 10

| View | Particle 1 | Particle 2 | | Particle 94 | Particle 95 | Particle 96 | Particle 97 | Particle 98 | Particle 99 | Particle 100 |
|---|---|---|---|---|---|---|---|---|---|---|
| 1 | 0.84 | 0.94 | | 0.96 | 0.71 | 0.91 | 0.85 | 0.74 | 0.78 | 0.73 |
| 2 | 0.77 | 0.82 | | 0.89 | 0.85 | 0.84 | 0.86 | 0.74 | 0.85 | 0.95 |
| 3 | 0.80 | 0.96 | | 0.91 | 0.76 | 0.78 | 0.90 | 0.80 | 0.76 | 0.93 |
| 4 | 0.72 | 0.89 | | 0.97 | 0.77 | 0.92 | 0.82 | 0.74 | 0.70 | 0.90 |
| 5 | 0.86 | 0.75 | | 0.83 | 0.82 | 0.95 | 0.82 | 0.95 | 0.87 | 0.82 |
| 6 | 0.93 | 0.86 | | 0.78 | 0.95 | 0.72 | 0.82 | 0.92 | 0.85 | 0.84 |
| 7 | 0.87 | 0.86 | | 0.71 | 0.72 | 0.69 | 0.85 | 0.76 | 0.86 | 0.71 |
| 8 | 0.72 | 0.74 | | 0.77 | 0.96 | 0.88 | 0.80 | 0.79 | 0.78 | 0.81 |
| ⋮ | ⋮ | ⋮ | | ⋮ | ⋮ | ⋮ | ⋮ | ⋮ | ⋮ | ⋮ |
| 21 | 0.89 | 0.78 | | 0.72 | 0.87 | 0.90 | 0.92 | 0.72 | 0.97 | 0.93 |
| 22 | 0.78 | 0.79 | | 0.86 | 0.93 | 0.92 | 0.85 | 0.86 | 0.79 | 0.90 |
| 23 | 0.85 | 0.76 | | 0.81 | 0.96 | 0.82 | 0.93 | 0.93 | 0.73 | 0.88 |
| 24 | 0.87 | 0.84 | | 0.84 | 0.93 | 0.86 | 0.89 | 0.83 | 0.95 | 0.83 |
| 25 | 0.71 | 0.85 | | 0.80 | 0.90 | 0.84 | 0.87 | 0.81 | 0.83 | 0.75 |
| 26 | 0.86 | 0.96 | | 0.81 | 0.73 | 0.77 | 0.83 | 0.75 | 0.93 | 0.83 |
| 27 | 0.96 | 0.92 | | 0.79 | 0.80 | 0.74 | 0.84 | 0.75 | 0.77 | 0.79 |
| 28 | 0.77 | 0.92 | | 0.91 | 0.88 | 0.79 | 0.83 | 0.95 | 0.85 | 0.80 |
| 29 | 0.75 | 0.83 | | 0.79 | 0.77 | 0.81 | 0.86 | 0.71 | 0.82 | 0.91 |
| 30 | 0.86 | 0.75 | | 0.82 | 0.78 | 0.76 | 0.89 | 0.72 | 0.85 | 0.74 |
| Average value | 0.833 | 0.866 | | 0.829 | 0.832 | 0.853 | 0.807 | 0.833 | 0.817 | 0.831 |
| Number of conforming particles 98 | 1 | 1 | | 1 | 1 | 1 | 1 | 1 | 1 | 1 |

FIG. 12

TONER AND METHOD FOR MANUFACTURING THE SAME

INCORPORATION BY REFERENCE

The present application claims priority under 35 U.S.C. §119 to Japanese Patent Application No. 2013-224525, filed Oct. 29, 2013. The contents of this application are incorporated herein by reference in their entirety.

BACKGROUND

The present disclosure relates to a toner and a method for manufacturing the toner, and in particular to a capsule toner and a method for manufacturing the capsule toner.

A capsule toner is one suggestion for improving the high-temperature preservability and low-temperature fixability of the toner. Each toner particle of a capsule toner has a core and a shell layer (capsule layer) on the surface of the core.

SUMMARY

A toner according to the present disclosure includes a plurality of toner particles. Each toner particle has a core and a shell layer on a surface of the core. In a cross section of the toner particle analyzed by EELS, for at least 50% of a circumferential length of the core, the shell layer has one or more portions each satisfying conditions that: a ratio of INc to INs is no less than 0.0 and no greater than 0.2; and a thickness of the shell layer portion is at least 5 nm. Here, INs indicates an intensity of an N-K shell absorption-edge originating from nitrogen atoms in the shell layer, and INc indicates an intensity of an N-K shell absorption-edge originating from nitrogen atoms in the core. The longest length among the one or more portions of the shell layer each satisfying the conditions is at least 100 nm.

A method for manufacturing a toner according to the present disclosure includes: forming cores; putting the cores and a material of shell layers into a liquid; and forming, in the liquid, the shell layers on surfaces of the cores to obtain toner particles. The method involves adjusting at least one of an acid value of the cores, an additive amount of the material of the shell layers, and a miscibility of the material of the shell layers. The adjustment is made such that: in a cross section of each toner particle analyzed by EELS, for at least 50% of a circumferential length of the core, the shell layer has one or more portions each satisfying conditions that a ratio of INc to INs is no less than 0.0 and no greater than 0.2; and that a thickness of the shell layer is at least 5 nm; and the longest length among the one or more portions of the shell layer each satisfying the conditions is at least 100 nm. Here, INs indicates an intensity of an N-K shell absorption-edge originating from nitrogen atoms in the shell layer, and INc indicates an intensity of an N-K shell absorption-edge originating from nitrogen atoms in the core.

BRIEF DESCRIPTION OF THE DRAWINGS

FIG. 10 is a table illustrating a method for measuring EELS intensity of a core in Example of the present disclosure.

FIG. 12 is a table illustrating a method for calculating a coverage ratio of a core in Example of the present disclosure.

DETAILED DESCRIPTION

The following describes an embodiment of the present disclosure.

A toner according to the present embodiment is a capsule toner for developing an electrostatic image. The toner according to the present embodiment is powder that includes a large number of particles (hereinafter referred to as toner particles). The toner according to the present embodiment can for example be used in an electrophotographic apparatus (image forming apparatus).

The electrophotographic apparatus uses a toner-containing developer to develop an electrostatic image. Through the development, electrically charged toner adheres to an electrostatic latent image which is formed on a photosensitive member. The toner is transferred onto a transfer belt as a toner image, and the toner image on the transfer belt is subsequently transferred onto a recording medium (for example, paper). The toner is then fixed to the recording medium through heating. Through the above, an image is formed on the recording medium. A full-color image can be formed by superimposing toner images formed using four different colors such as black, yellow, magenta, and cyan.

Figure 1:
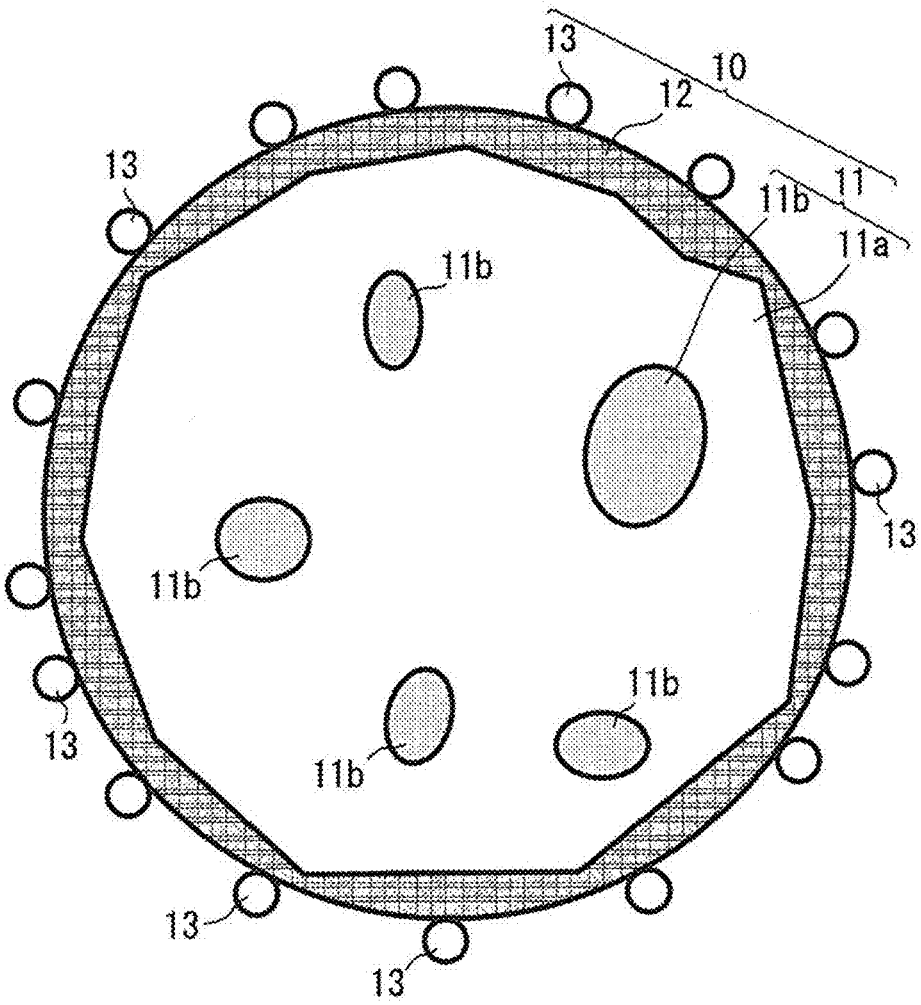
FIG. 1 shows a toner particle included in a toner according to an embodiment of the present disclosure.

The following describes the structure of the toner (in particular, the toner particles) according to the present embodiment with reference to FIG. 1. FIG. 1 shows one of toner particles 10 included in the toner according to the present embodiment.

As shown in FIG. 1, the toner particle 10 includes a core 11, a shell layer (capsule layer) 12 on the surface of the core 11, and an external additive 13.

The core 11 contains a binder resin 11*a* and one or more internal additives 11*b* (for example a colorant, a releasing agent, a charge control agent, and a magnetic powder). The core 11 is covered by the shell layer 12. The external additive 13 adheres to the surface of the shell layer 12. In the following description, particles prior to an external addition treatment (toner particles 10 to which no external additive 13 adheres) are referred to as "toner mother particles".

The structure of the toner particles is not limited to the one described above. For example, the internal additive 11*b* and/or the external additive 13 may be omitted depending on necessity thereof. The toner particle may contain a plurality of shell layers 12 layered on the surface of the core 11. When the toner particle includes a plurality of shell layers 12 that are layered on one another, the outermost one of the shell layers 12 is preferably be cationic.

It is preferable that the core 11 is anionic and a material of the shell layer 12 (herein referred to as a shell material) is cationic. The core 11 being anionic means that the cationic shell material can be attracted toward the surface of the core 11 during formation of the shell layer 12. In particular, the shell material, which is positively charged in an aqueous medium, is electrically attracted toward the core 11, which is negatively charged in for example the aqueous medium. The shell material thus attracted forms the shell layer 12 on the surface of the core 11 through for example in-situ polymerization. With the shell material being attracted to the core 11, formation of the shell layer 12 uniformly on the surface of the core 11 is facilitated without the use of a dispersant to disperse the cores 11 in an aqueous medium.

In the present embodiment, the zeta potential of the cores 11 having a negative polarity (i.e., being less than 0 V) when measured in an aqueous medium adjusted to pH 4 is used as an indicator that the cores 11 are anionic. In order to increase the bonding strength of the cores 11 and the shell layers 12, the zeta potential of the cores 11 at pH 4 is preferably less than 0 V and the zeta potential of the toner particles 10 at pH 4 is preferably greater than 0 V. Note that in the present embodiment, pH 4 is equivalent to the pH of the aqueous solution during formation of the shell layers 12.

Examples of methods for measuring the zeta potential include an electrophoresis method, an ultrasound method, and an electric sonic amplitude (ESA) method.

The electrophoresis method involves applying an electrical field to a liquid dispersion of particles, causing electrical migration of charged particles in the dispersion, and calculating the zeta potential based on the migration speed. An example of the electrophoresis method is laser Doppler electrophoresis in which migrating particles are irradiated with laser light to obtain scattered light and the migration speed of the particles is calculated from an amount of Doppler shift of the scattered light. Advantages of laser Doppler electrophoresis are a lack of necessity for particle concentration in the dispersion to be high, a low number of parameters being necessary for calculating the zeta potential, and a good degree of sensitivity in migration speed detection.

The ultrasound method involves irradiating a liquid dispersion of particles with ultrasound, causing vibration of electrically charged particles in the dispersion, and calculating the zeta potential based on an electric potential difference that arises due to the vibration.

The ESA method involves applying a high frequency voltage to a liquid dispersion of particles, thereby causing electrically charged particles in the dispersion to vibrate and generate ultrasound. The zeta potential is calculated from the magnitude (intensity) of the ultrasound.

An advantage of the ultrasound method and the ESA method is that the zeta potential can be measured to a good degree of sensitivity even when particle concentration of the dispersion is high (for example, exceeding 20% by mass).

In manufacture of a toner, it is preferable to avoid using a dispersant (surfactant). In a toner manufactured without the use of a dispersant, neither the cores 11 nor the shell layers 12 are assumed to contain a dispersant. Typically, a dispersant has a high drainage load. When a dispersant is not used, the amount of water used during a washing process can be reduced. Also, when a dispersant is not used, the total organic carbon (TOC) concentration of drainage discharged during preparation of the toner particles 10 can be kept at a low level, not exceeding 15 mg/L, without diluting the drainage.

An organic component (for example, unreacted monomers, prepolymers, and the dispersant) of drainage can be measured by measuring biochemical oxygen demand (BOD), chemical oxygen demand (COD), or TOC. Among the above, TOC concentration can be used to reliably measure all organic compounds. Also, measurement of TOC concentration can identify an amount of the organic component of drainage (all filtrates and washing solutions produced after reaction) that is unrelated to capsulation.

The following sequentially describes the core 11 (the binder resin 11*a* and the internal additive 11*b*), the shell layer 12, and the external additive 13. Note that acrylic acid and methacrylic acid may collectively referred to by a generic term "(meth)acrylic acid".

[Core]

The core 11 contains a binder resin 11*a*. The cores 11 may additionally include one or more internal additives 11*b* (for example a colorant, a releasing agent, a charge control agent and a magnetic powder). Optional components (for example, the colorant, the releasing agent, the charge control agent, and the magnetic powder) may alternatively be omitted in accordance with intended use of the toner.

[Binder Resin (Core)]

The binder resin 11*a* constitutes a large proportion (for example, at least 85% by mass) of content of the cores 11. Therefore, the polarity of the binder resin 11*a* has a significant influence on the overall polarity of the cores 11. For example, when the binder resin 11*a* has an ester group, a hydroxyl group, an ether group, an acid group, or a methyl group, the cores 11 have a strong tendency to be anionic. On the other hand, for example, when the binder resin 11*a* has an amino group, an amine, or an amide group, the cores 11 have a strong tendency to be cationic.

In order that the binder resin 11*a* is strongly anionic, a hydroxyl value (OHV value) and an acid value (AV value) of the binder resin 11*a* are preferably each at least 10 mg KOH/g, and more preferably at least 20 mg KOH/g.

A glass transition point (Tg) of the binder resin 11*a* is preferably no greater than the curing initiation temperature of a thermosetting resin contained in the shell layers 12. The use of the binder resin 11*a* having such Tg is assumed to facilitate the resulting toner to be sufficiently fixed even during high-speed fixing. Commonly, the curing initiation temperature of the thermosetting resin (in particular, a melamine-based resin) is approximately 55° C. The glass transition point (Tg) of the binder resin 11*a* is preferably no less than 20° C., more preferably no less than 30° C. and no greater than 55° C., and particularly preferably no less than 30° C. and no greater than 50° C. When Tg of the binder resin 11*a* is no less than 20° C., the cores 11 have a low tendency to aggregate during formation of the shell layers 12.

The softening point (Tm) of the binder resin 11*a* is preferably no greater than 100° C. and more preferably no greater than 95° C. The use of the binder resin 11*a* having Tm no greater than 100° C. (more preferably, no greater than 95° C.) is assumed to facilitate the resulting toner to be sufficiently fixed even during high-speed fixing. With the use of the binder resin 11*a* having Tm that is no greater than 100° C. (more preferably, no greater than 95° C.), the cores 11 partially soften during a curing reaction of the shell layers 12 that occurs when the shell layers 12 are formed on the surface of the cores 11 in the aqueous medium. The cores 11 softened in this way each approach a rounded shape due to the surface tension. Note that Tm of the binder resin 11*a* can be adjusted by combining a plurality of binder resins each having a different Tm.

Figure 2:
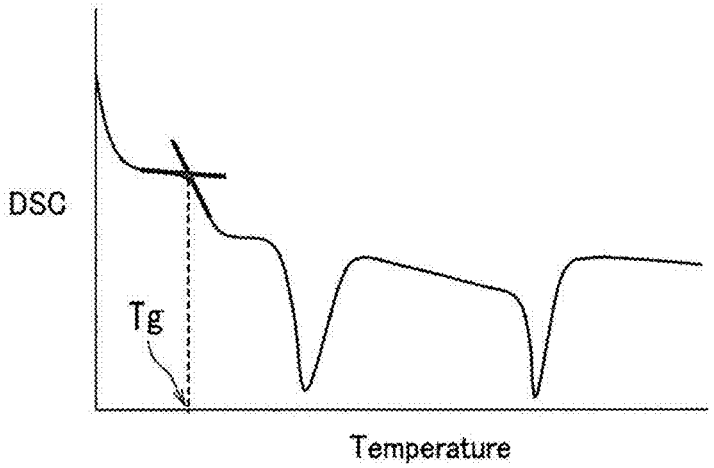
FIG. 2 illustrates a method for reading a glass transition point from a heat absorption curve.

With reference to FIG. 2, the following explains a method for reading Tg of the binder resin 11*a* from a heat absorption curve. FIG. 2 is a graph illustrating an example of the heat absorption curve.

The glass transition point (Tg) of the binder resin 11*a* can be measured by a method as described below. The heat absorption curve of the binder resin 11*a* can be measured using a differential scanning calorimeter (for example, "DSC-6220" manufactured by Seiko Instruments Inc.). For example, the heat absorption curve as shown in FIG. 2 is obtained. The glass transition point (Tg) of the binder resin 11*a* is determined from the heat absorption curve thus obtained (specifically, an inflection point of specific heat of the binder resin 11*a*).

Figure 3:
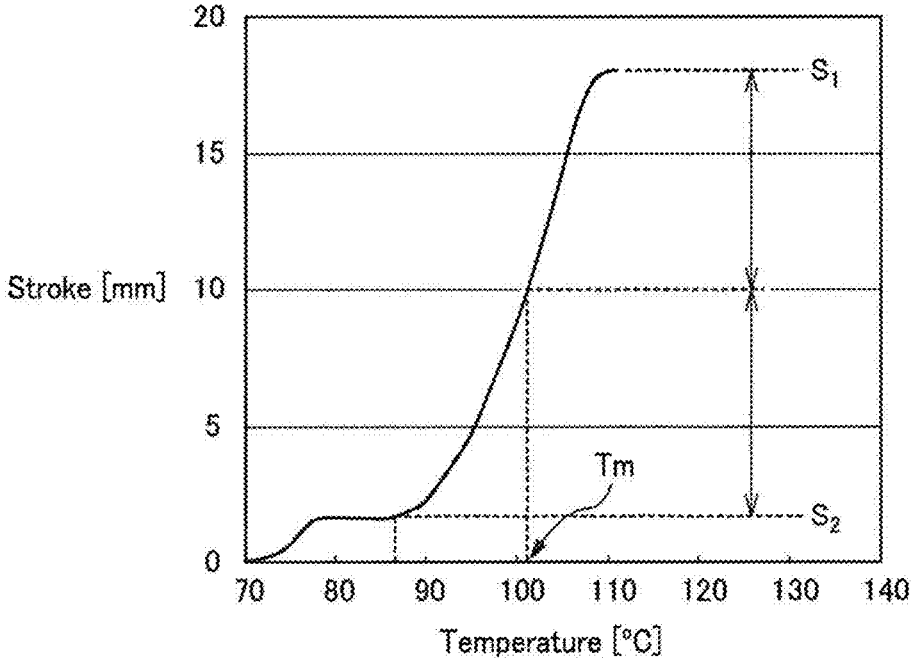
FIG. 3 illustrates a method for reading a softening point from an S-shaped curve.

A method for reading Tm of the binder resin 11*a* from the S-shaped curve is explained with reference to FIG. 3. FIG. 3 shows an exemplary S-shaped curve.

The softening point (Tm) of the binder resin 11*a* can be measured by a method as described below. A capillary rheometer (for example, "CFT-500D" manufactured by Shimadzu Corporation) can be used to measure the softening point (Tm) of the binder resin 11*a*. For example, the binder resin 11*a* (measurement sample) is set in the capillary rheometer and caused to melt flown under the specific conditions to obtain an S-shaped curve of stroke [mm]/temperature [° C.]. Then, Tm of the binder resin 11*a* is read from the thus obtained S-shaped curve. In FIG. 3, $S_1$ indicates a maximum stroke value and $S_2$ indicates a base line stroke value at low temperatures. A temperature corresponding to a point on the S-shaped curve at which the stroke value is equal to $(S_1+S_2)/2$ is determined to be Tm of the measurement sample.

The following continues explanation of the binder resin 11*a* shown in FIG. 1. The binder resin 11*a* is preferably a resin having a functional group such as an ester group, a hydroxyl group, an ether group, an acid group, a methyl group, or a carboxyl group, and more preferably is a resin having either or both of a hydroxyl group and a carboxyl group in a molecule of the resin. The cores 11 (binder resin 11*a*) having a functional group such as listed above facilitates the cores 11 to chemically bond to the shell material (for example, methylol melamine). Such chemical bonding causes the cores 11 to be strongly bound to the shell layers 12.

The binder resin 11*a* is preferably a thermoplastic resin. Preferable examples of the thermoplastic resin include styrene-based resins, acrylic-based resins, styrene-acrylic-based resins, polyethylene-based resins, polypropylene-based resins, vinyl chloride-based resins, polyester resins, polyamide-based resins, polyurethane-based resins, polyvinyl alcohol-based resins, vinyl ether-based resins, N-vinyl-based resins, and styrene-butadiene-based resins. Among the examples listed above, styrene-acrylic-based resins and polyester resins have excellent properties in terms of dispersibility of the colorant in the toner, chargeability of the toner, and fixability of the toner on a recording medium.

(Styrene-Acrylic-Based Resin)

The styrene-acrylic-based resin is for example a copolymer of a styrene-based monomer and an acrylic-based monomer.

Preferable examples of the styrene-based monomer used to prepare a styrene-acrylic-based resin (the binder resin 11*a*) include styrene, α-methylstyrene, p-hydroxystyrene, m-hydroxystyrene, vinyltoluene, α-chlorostyrene, o-chlorostyrene, m-chlorostyrene, p-chlorostyrene, and p-ethylstyrene.

Preferable examples of the acrylic-based monomer used to prepare a styrene-acrylic-based resin (the binder resin 11*a*) include (meth)acrylic acid, alkyl esters of (meth)acrylic acid, and hydroxyalkyl esters of (meth)acrylic acid. Preferable examples of alkyl esters of (meth)acrylic acid include methyl (meth)acrylate, ethyl (meth)acrylate, n-propyl (meth)acrylate, iso-propyl (meth)acrylate, n-butyl (meth)acrylate, iso-butyl (meth)acrylate, and 2-ethylhexyl (meth)acrylate. Preferable examples of hydroxyalkyl esters of (meth)acrylic acid include 2-hydroxyethyl (meth)acrylate, 3-hydroxypropyl (meth)acrylate, 2-hydroxypropyl (meth)acrylate, and 4-hydroxypropyl (meth)acrylate.

A hydroxyl group can be introduced into the styrene-acrylic-based resin using a monomer having a hydroxyl group (for example, p-hydroxystyrene, m-hydroxystyrene, or a hydroxyalkyl ester of (meth)acrylic acid) during preparation of the styrene-acrylic-based resin. The hydroxyl value of the styrene-acrylic-based resin can for example be adjusted by appropriately adjusting the amount of the monomer having the hydroxyl group that is used.

A carboxyl group can be introduced into the styrene-acrylic-based resin using (meth)acrylic acid (monomer) during preparation of the styrene-acrylic-based resin. The acid value of the styrene-acrylic-based resin can for example be adjusted by appropriately adjusting the amount of (meth) acrylic acid that is used.

When the binder resin 11*a* is a styrene-acrylic-based resin, in order to improve the strength of the cores 11 and the fixability of the toner, the styrene-acrylic-based resin preferably has a number average molecular weight (Mn) of no less than 2,000 and no greater than 3,000. The styrene-acrylic-based resin preferably has a molecular weight distribution (i.e., a ratio Mw/Mn of a mass average molecular weight (Mw) to the number average molecular weight (Mn)) of no less than 10 and no greater than 20. To measure Mn and Mw of the styrene-acrylic-based resin, gel permeation chromatography can be used.

(Polyester Resin)

The polyester resin used as the binder resin 11*a* is prepared through, for example, condensation polymerization or condensation copolymerization of a dihydric alcohol or alcohol having three or more hydroxyl groups and a dicarboxylic acid or carboxylic acid having three or more carboxyl groups.

When the binder resin 11*a* is a polyester resin, preferable examples of the alcohol used to prepare the polyester resin include diols, bisphenols, and alcohols having three or more hydroxyl groups.

Specific examples of diols include ethylene glycol, diethylene glycol, triethylene glycol, 1,2-propanediol, 1,3-propanediol, 1,4-butanediol, neopentyl glycol, 1,4-butenediol, 1,5-pentanediol, 1,6-hexanediol, 1,4-cyclohexanedimethanol, dipropylene glycol, polyethylene glycol, polypropylene glycol, and polytetramethylene glycol.

Specific examples of preferable bisphenols include bisphenol A, hydrogenated bisphenol A, polyoxyethylenated bisphenol A, and polyoxypropylenated bisphenol A.

Specific examples of alcohols having three or more hydroxyl groups include sorbitol, 1,2,3,6-hexanetetraol, 1,4-sorbitan, pentaerythritol, dipentaerythritol, tripentaerythritol, 1,2,4-butanetriol, 1,2,5-pentanetriol, glycerol, diglycerol, 2-methylpropanetriol, 2-methyl-1,2,4-butanetriol, trimethylolethane, trimethylolpropane, and 1,3,5-trihydroxymethylbenzene.

When the binder resin 11*a* is a polyester resin, preferable examples of the carboxylic acids used to prepare the polyester resin include a dicarboxylic acid or a carboxylic acid having three or more carboxyl groups.

Preferable examples of the dicarboxylic acid include maleic acid, fumaric acid, citraconic acid, itaconic acid, glutaconic acid, phthalic acid, isophthalic acid, terephthalic acid, cyclohexanedicarboxylic acid, adipic acid, sebacic acid, azelaic acid, malonic acid, succinic acid, alkyl succinic acids (specifically, n-butyl succinic acid, isobutylsuccinic acid, n-octylsuccinic acid, n-dodecylsuccinic acid, and isododecylsuccinic acid), and alkenyl succinic acids (specifically, n-butenyl succinic acid, isobutenylsuccinic acid, n-octenylsuccinic acid, n-dodecenylsuccinic acid, and isododecenylsuccinic acid).

Preferable examples of the carboxylic acids having three or more carboxyl groups include 1,2,4-benzenetricarboxylic acid (trimellitic acid), 1,2,5-benzenetricarboxylic acid, 2,5,7-naphthalenetricarboxylic acid, 1,2,4-naphthalenetricarboxylic acid, 1,2,4-butanetricarboxylic acid, 1,2,5-hexanetricarboxylic acid, 1,3-dicarboxyl-2-methyl-2-methylenecarboxypropane, 1,2,4-cyclohexanetricarboxylic acid, tetra(methylenecarboxyl)methane, 1,2,7,8-octanetetracarboxylic acid, pyromellitic acid, and EMPOL trimer acid.

Alternatively, the dicarboxylic acid or carboxylic acid having three or more carboxyl groups to be used may be altered to an ester-forming derivative (for example, an acid halide, an acid anhydride, or a lower alkyl ester). The term "lower alkyl" used herein refers to an alkyl group having 1 to 6 carbon atoms.

The acid value and the hydroxyl value of the polyester resin can be adjusted by appropriately changing the amount of the dihydric alcohol or alcohol having three or more hydroxyl groups and the amount of the dicarboxylic acid or carboxylic acid having three or more carboxyl groups used to prepare the polyester resin. Increasing the molecular weight of the polyester resin tends to decrease the acid value and the hydroxyl value of the polyester resin.

When the binder resin 11*a* is a polyester resin, in order to improve the strength of the cores 11 and the fixability of the toner, the polyester resin preferably has a number average molecular weight (Mn) of no less than 1,200 and no greater than 2,000. The polyester resin preferably has a molecular weight distribution (i.e., a ratio Mw/Mn of a mass average molecular weight (Mw) to the number average molecular weight (Mn)) of no less than 9 and no greater than 20. To measure Mn and Mw of the polyester resin, gel permeation chromatography can be used.

[Colorant (Core)]

The cores 11 may contain a colorant as needed. For the colorant, a known pigment or dye may be used in accordance with the color of the toner particles. The amount of the colorant is preferably no less than 1 part by mass and no greater than 20 parts by mass to 100 parts by mass of the binder resin 11*a*, and more preferably is no less than 3 parts by mass and no greater than 10 parts by mass.

(Black Colorant)

The cores 11 may contain a black colorant as needed. The black colorant may for example be carbon black. Alternatively, a colorant can be used that has been adjusted to a black color using colorants such as a yellow colorant, a magenta colorant, and a cyan colorant.

(Non-Black Colorants)

The cores 11 may contain a non-black colorant such as a yellow colorant, a magenta colorant, or a cyan colorant.

Examples of yellow colorants include a condensed azo compound, an isoindolinone compound, an anthraquinone compound, an azo metal complex, a methine compound, and an allylamide compound. Preferable examples of yellow colorants include C.I. pigment yellow (3, 12, 13, 14, 15, 17, 62, 74, 83, 93, 94, 95, 97, 109, 110, 111, 120, 127, 128, 129, 147, 151, 154, 155, 168, 174, 175, 176, 180, 181, 191, and 194), naphthol yellow S, Hansa yellow G, and C.I. vat yellow.

Examples of magenta colorants include a condensed azo compound, a diketopyrrolopyrrole compound, an anthraquinone compound, a quinacridone compound, a basic dye lake compound, a naphthol compound, a benzimidazolone compound, a thioindigo compound, and a perylene compound. Preferable examples of magenta colorants include C.I. pigment red (2, 3, 5, 6, 7, 19, 23, 48:2, 48:3, 48:4, 57:1, 81:1, 122, 144, 146, 150, 166, 169, 177, 184, 185, 202, 206, 220, 221, and 254).

Examples of cyan colorants include a copper phthalocyanine compound, a copper phthalocyanine derivative, an anthraquinone compound, and a basic dye lake compound. Preferable examples of cyan colorants include C.I. pigment blue (1, 7, 15, 15:1, 15:2, 15:3, 15:4, 60, 62, and 66), phthalocyanine blue, C.I. vat blue, and C.I. acid blue.

[Releasing Agent (Core)]

The cores 11 may contain a colorant as needed. The releasing agent is for example used to improve the fixability or the offset resistance of the toner. In order to improve the fixability or the offset resistance of the toner, the amount of the releasing agent is preferably no less than 1 part by mass and no greater than 30 parts by mass to 100 parts by mass of the binder resin 11*a*, and more preferably is no less than 5 parts by mass and no greater than 20 parts by mass.

Preferable examples of the releasing agent include: aliphatic hydrocarbon-based waxes such as low molecular weight polyethylene, low molecular weight polypropylene, polyolefin copolymer, polyolefin wax, microcrystalline wax, paraffin wax, or Fischer-Tropsch wax; oxides of aliphatic hydrocarbon-based waxes such as polyethylene oxide wax or block copolymer of polyethylene oxide wax; plant waxes such as candelilla wax, carnauba wax, Japan wax, jojoba wax, or rice wax; animal waxes such as beeswax, lanolin, or spermaceti; mineral waxes such as ozocerite, ceresin, or petrolatum; waxes having a fatty acid ester as major component such as montanic acid ester wax or castor wax; and waxes such as deoxidized carnauba wax in which a part or all of a fatty acid ester has been deoxidized.

[Charge Control Agent (Cores)]

The cores 11 may contain a charge control agent as needed. The charge control agent is for example used to improve charge stability and a charge rise characteristic of the toner. The presence of a negatively chargeable charge control agent in the cores 11 can strengthen the anionic nature of the cores 11. The charge rise characteristic of the toner is an indicator of whether or not the toner can be charged to a specific charging level in a short period of time.

[Magnetic Powder (Cores)]

The cores 11 may contain magnetic powder as needed. When the toner is used as a one-component developer, the amount of the magnetic powder is preferably no less than 35 parts by mass and no greater than 60 parts by mass to 100 parts by mass of the toner overall, and more preferably is no less than 40 parts by mass and no greater than 60 parts by mass.

Preferable examples of the magnetic powder include iron (specifically, ferrite or magnetite), ferromagnetic metals (specifically, cobalt or nickel), alloys of either or both of iron and a ferromagnetic metal, ferromagnetic alloys subjected to ferromagnetization (such as heat treatment), and chromium dioxide.

In order to uniformly disperse the magnetic powder in the binder resin 11*a*, the magnetic powder preferably has a particle diameter of no less than 0.1 μm and no greater than 1.0 μm, and more preferably no less than 0.1 μm and no greater than 0.5 μm.

[Shell Layer]

Preferably, the shell layers 12 are mainly formed from a thermosetting resin. Also, in order to improve the strength, hardness, and cationic nature of the shell layers 12, preferably the shell layers 12 is mainly formed from a resin containing nitrogen atoms (for example, amino groups) or from a derivative of such a resin. The presence of nitrogen atoms in the shell layers 12 facilities the shell layers 12 to be positively charged. In order to strengthen the cationic nature of the shell layers 12, preferably the shell layers 12 contain at least 10% by mass of nitrogen atoms.

Preferable examples of the thermosetting resin contained in the shell layers 12 include melamine resins, urea resins, sulfonamide resins, glyoxal resins, guanamine resins, aniline resins, polyimide resins, and derivatives of any of the aforementioned resins. A polyimide resin has a molecular framework of nitrogen atoms. Therefore, shell layers 12 containing a polyimide resin tend to be strongly cationic. Preferable examples of the polyimide resin contained in the shell layers 12 include maleimide-based polymers and bismaleimide-based polymers (for example, amino-bismaleimide polymers, or bismaleimide triazine polymers).

In particular, the thermosetting resin contained in the shell layers 12 is preferably a resin (hereinafter referred to as an amino-aldehyde resin) produced through polycondensation of an aldehyde (for example, formaldehyde) and a compound containing an amino group. The melamine resin is a polycondensate of melamine and formaldehyde. The urea resin is a polycondensate of urea and formaldehyde. The glyoxal resin is a polycondensate of formaldehyde and a reaction product of glyoxal and urea.

The thermosetting resin contained in the shell layers 12 can be prepared using a monomer (shell material) such as methylol melamine, benzoguanamine, acetoguanamine, or spiroguanamine, for example. Preferably, the shell material is a material that disperses in water.

Preferably, at least 80% by mass of the total resin content of the shell layers 12 is the thermosetting resin. More preferably, at least 90% by mass is the thermosetting resin. Particularly preferably, 100% by mass is the thermosetting resin.

For the cationic (positively chargeable) shell layers 12, a positively chargeable charge control agent may be contained in order to strengthen the cationic nature (positive chargeability) of the shell layers 12.

[External Additive]

The shell layers 12 may contain the external additive 13 adhered to the surface of the shell layer 12. The external additive 13 is for example used in order to improve the fluidity or handleability of the toner. In order to improve the fluidity or handleability of the toner, the amount of the external additive 13 is preferably no less than 0.5 parts by mass and no greater than 10 parts by mass to 100 parts by mass of the toner mother particles, and more preferably is no less than 2 parts by mass and no greater than 5 parts by mass.

Preferable examples of the external additive 13 include silica and metal oxides (for example, alumina, titanium oxide, magnesium oxide, zinc oxide, strontium titanate, or barium titanate).

In order to improve the fluidity or handleability of the toner, the external additive 13 preferably has a particle diameter of no less than 0.01 μm and no greater than 1.0 μm.

The toner according to the present embodiment has the following structure in a cross-section of the toner particle 10 analyzed by electron energy loss spectroscopy (EELS). Here, INs indicates the intensity of an N-K shell absorption-edge originating from nitrogen atoms in the shell layer 12, and INc indicates the intensity of an N-K shell absorption-edge originating from nitrogen atoms in the core 11. That is, in the toner according to the present embodiment, at least 50% of the circumferential length of the core 11 is covered by one or more portions of the shell layer 12 each satisfying the conditions that: a ratio INc/INs, which is the ratio of INc to INs, is no less than 0.0 and no greater than 0.2; and the thickness of the shell layer 12 is at least 5 nm (the conditions related to the EELS intensities and the layer thickness). In addition, the longest length among the one or more portions of the shell layer 12 each satisfying the above conditions is 100 nm.

The toner according to the present embodiment has excellent properties in terms of both high-temperature preservability and low-temperature fixability.

In order to improve the high-temperature preservability and low-temperature fixability of the toner, the toner according to the present embodiment is preferably such that the greatest thickness among the one or more portions of the shell layer 12 each satisfying the above conditions (the conditions related to the EELS intensities and layer thickness) is no less than 5 nm and no greater than 15 nm. In order to improve the high-temperature preservability and low-temperature fixability of the toner, the toner according to the present embodiment is preferably such that: no less than 65% and no greater than 86% of the circumferential length of the core 11 is covered by the one or more portions of the shell layer 12 each satisfying the above conditions (the conditions related to the EELS intensities and layer thickness); and the longest length among the one or more portions of the shell layer 12 each satisfying the above conditions (the conditions related to the EELS intensities and layer thickness) is no less than 350 nm and no greater than 1,000 nm. In order to improve the high-temperature preservability of the toner, the toner according to the present embodiment is such that the shell layer preferably contains a thermosetting resin.

The following describes, a method according to the present embodiment for manufacturing the toner.

According to the present embodiment, the method for manufacturing the toner involves forming the cores 11. Next, the cores 11 and a shell material are put into a liquid. Subsequently, in the liquid, shell layers 12 are formed on the surfaces of the cores 11 to obtain toner particles 10. Then, at least one of the acid value of the cores 11, the additive amount of the shell material, and the miscibility of the shell material is adjusted. The adjustment is made in order to ensure that at least 50% of the circumferential length of the core 11 is covered by one or more portions of the shell layer 12 each satisfying the conditions that: the ratio of INc to INs (INc/INs) is no less than 0.0 and no greater than 0.2; and the thickness of the shell layer is at least 5 nm and also to ensure that the longest length among the one or more portions of the shell layer 12 each satisfying the above conditions is at least 100 nm.

By the method according to the present embodiment, the toner can be manufactured to have excellent properties in terms of both thigh-temperature preservability and low-temperature fixability.

In order to manufacture a toner having excellent properties in terms of both high-temperature preservability and low-temperature fixability, the miscibility of the shell material used in the method according to the present embodiment is preferably no less than 200 parts by mass and no greater than 500 parts by mass. In order to manufacture a toner having excellent properties in terms of both high-temperature preservability and low-temperature fixability, the acid value of the cores 11 used in the method according to the present embodiment is preferably no less than 10 mgKOH/g and no greater than 35 mgKOH/g.

EXAMPLES

The following describes Examples of the present disclosure. Table 1 shows toners A to Q relating to Examples and Comparative Examples.

TABLE 1

| Toner | Core | Shell | Miscibility [% by mass] | Circularity |
|---|---|---|---|---|
| Toner A | Core A | Shell material A (2.0 mL) | 500 | 0.972 |
| Toner B | Core A | Shell material A (1.0 mL) | 500 | 0.976 |
| Toner C | Core A | Shell material A (4.0 mL) | 500 | 0.965 |
| Toner D | Core A | Shell material A (0.5 mL) | 500 | 0.978 |
| Toner E | Core A | Shell material A (0.1 mL) | 500 | 0.989 |
| Toner F | Core B | Shell material A (2.0 mL) | 500 | 0.970 |
| Toner G | Core B | Shell material A (4.0 mL) | 500 | 0.963 |
| Toner H | Core C | Shell material A (2.0 mL) | 500 | 0.982 |
| Toner I | Core C | Shell material A (4.0 mL) | 500 | 0.978 |
| Toner J | Core D | Shell material A (2.0 mL) | 500 | 0.971 |
| Toner K | Core D | Shell material A (4.0 mL) | 500 | 0.964 |
| Toner L | Core E | Shell material A (2.0 mL) | 500 | 0.981 |
| Toner M | Core E | Shell material A (4.0 mL) | 500 | 0.979 |
| Toner N | Core A | Shell material B (2.0 mL) | 200 | 0.970 |
| Toner O | Core A | Shell material B (4.0 mL) | 200 | 0.962 |
| Toner P | Core A | Shell material C (2.0 mL) | 1,000 | 0.977 |
| Toner Q | Core A | Shell material C (4.0 mL) | 1,000 | 0.970 |

The following sequentially explains a preparation method, an evaluation method, and evaluation results of the toners A to Q. Note that evaluation results (values indicating shape, physical properties, or the like) for a toner are average values measured with respect to an appropriate number of toner particles unless otherwise stated.

[Preparation Method of Toner A]

(Core Preparation)

The following explains a process for forming cores A in the preparation method of the toner A.

In the preparation method of the toner A, the cores A were prepared using a pulverization and classification method. In the preparation of the cores A, bisphenol A-ethylene oxide adduct (specifically, alcohol having bisphenol A as a framework to which ethylene oxide is added) was reacted with a polyfunctional acid (specifically, para-phthalic acid) to prepare a polyester resin (binder resin of the cores A). The resultant polyester resin had the hydroxyl group value (OHV value) of 9.7 mgKOH/g, the acid value (AV value) of 20 mgKOH/g, Tm of 100° C., and Tg of 49° C.

As the colorant, C.I. pigment blue 15:3 (phthalocyanine pigment) was used. As the releasing agent, ester wax ("WEP-3" manufactured by NOF Corporation) was used.

Using a mixer ("FM mixer" manufactured by Nippon Coke & Engineering Co. Ltd.), 5 parts by mass of the above colorant and 5 parts by mass of the above releasing agent were mixed into 100 parts by mass of the above polyester resin. Subsequently, the resulting mixture was melt-kneaded using a twin screw extruder ("PCM-30" manufactured by Ikegai Corp.), followed by pulverization using a mechanical pulverizer ("Turbo Mill" manufactured by FREUND-TURBO CORPORATION). The resultant pulverized product was classified using a classifying apparatus ("Elbow-Jet" manufactured by Nittetsu Mining Co., Ltd.). Through the above, cores A having a median diameter (volume distribution standard) of 6.1 μm were obtained. The resultant cores A were anionic.

The shape index (circularity) of the resultant cores A was 0.930. The circularity was measured using a flow particle image analyzer ("FPIA®-3000" manufactured by Sysmex Corporation).

The resultant cores A had Tg of 42° C. and Tm of 90° C. To measure Tg, a differential scanning calorimeter ("DSC-6200" manufactured by Seiko Instruments Inc.) was used. To measure Tm, a capillary rheometer ("CFT-500D" manufactured by Shimadzu Corporation) was used.

(Shell layer Formation)

The following explains a process for forming shell layers in the preparation method of the toner A.

First, a 1 L three-necked flask having a thermometer and a stirring impeller was set up in a water bath. Then, the internal temperature of the flask was maintained at 30° C. using the water bath. Next, 300 mL of ion exchanged water was added to the flask. The aqueous medium in the flask was adjusted to pH 4 through addition of dilute hydrochloric acid.

Then, 2 mL of a shell material A ("Mirben resin SUM-100" manufactured by Showa Denko K.K., solid concentration 80% by mass) was added to the flask and the contents of the flask were stirred, causing the shell material A to dissolve in the aqueous medium. The shell material A was an aqueous solution of methylolated urea, with a miscibility of 500.

Note that the miscibility refers to the solubility of a solvent (ion exchanged water) in the material of shell layers (shell material A). For example, the miscibility of 500% by mass means that a solvent up to five times (by mass) the shell material is miscible with the shell material. The miscibility tends to be lower as the degree of polymerization is higher.

The miscibility was measured in the following manner. While the material of the shell layers (shell material A) was kept stirring at the measurement temperature of 60° C., water was gradually added. The solubility limit of water with the shell material (the point at which the resultant mixture became clouded) was visually determined to measure the miscibility.

Subsequently, 300 g of the cores A was added to the flask and the contents of the flask were sufficiently stirred. Next, 300 mL of ion exchanged water was added to the flask and the contents of the flask were stirred while the internal temperature of the flask was increased to 70° C. at a rate of 1° C./minute. Then, the internal temperature of the flask was maintained at 70° C. for two hours.

As a result of the above two-hour stirring of the flask contents at 70° C. for two hours, cationic shell layers mainly composed of a thermosetting resin (urea resin) were formed on the surface of the cores 11. Thereafter, the contents of the flask were cooled to room temperature (25° C.). Consequently, the dispersion of toner mother particles was obtained.

(Washing and Drying)

Once the toner mother particles (cores and shell layers) were formed, the dispersion was filtered (subjected to solid-liquid separation) using a Büchner funnel. Through the above process, toner mother particles were obtained in the form of a wet cake. Subsequently, the toner mother particles were dispersed in ion exchanged water in the proportions of 1 g of the toner mother particles to 25 mL of ion exchanged water. The filtration and dispersion were alternately repeated to wash the toner mother particles. The filtration and dispersion were alternately repeated until the conductivity of the dispersion of 10 g toner mother particles in 100 g of ion exchanged water reached 3 μS/cm. The electrical conductivity was measured using an electrical conductivity meter ("HORIBA ES-51" manufactured by Horiba, Ltd.).

Subsequently, the wet cake of the washed toner mother particles was cracked, followed by drying for 12 hours using a vacuum oven.

(External Additive)

By using a 5 L mixer (FM mixer manufactured by Nippon Coke & Engineering Co. Ltd.), 100 parts by mass of the toner mother particles (powder) obtained through the above drying process was mixed for five minutes with 0.4 parts by mass of positively chargeable silica particulates (specifically, particulates obtained by treating the surfaces of 20 nm diameter primary particles of hydrophilic fumed silica ("AEROSIL® 90G" manufactured by Nippon Aerosil Co., Ltd.) with silicone oil and aminosilane). Through the above process, the external additive was adhered to the surface of the toner mother particles. Subsequently, a 300-mesh sieve (opening: 48 μm) was used to sift the mixture. Through the process described above, the toner A having a large number of toner particles was prepared.

Figure 4:
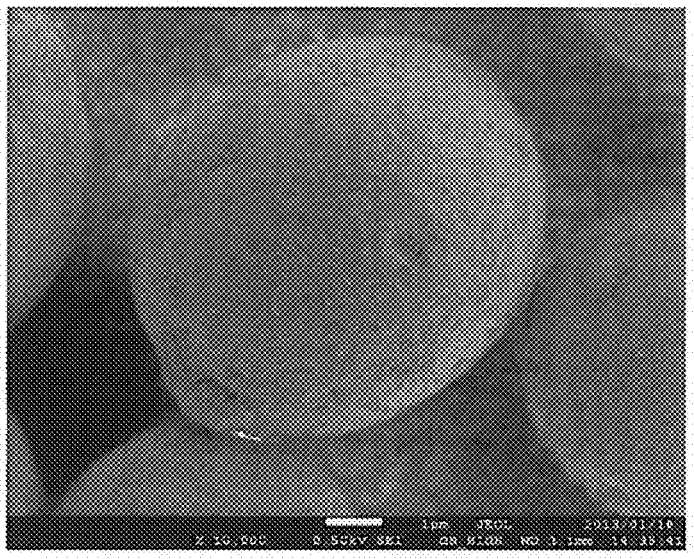
FIG. 4 is an SEM photograph showing a toner particle included in a toner according to Example of the present disclosure.
Figure 5:
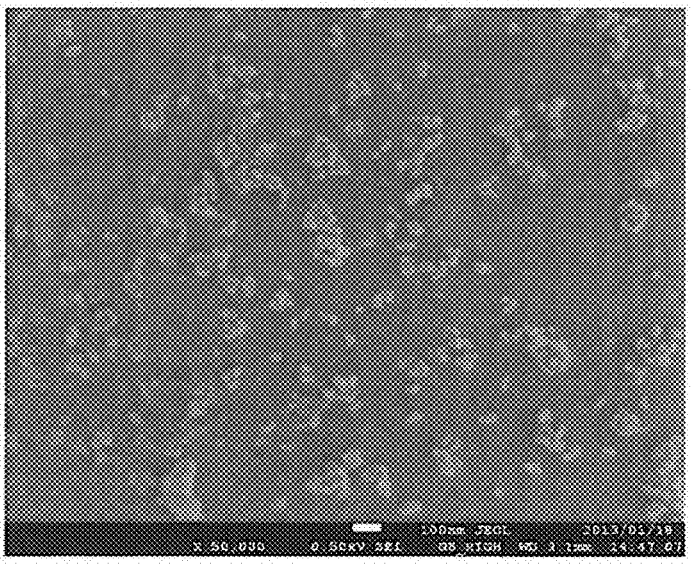
FIG. 5 is an SEM photograph showing a part of FIG. 4 in enlarged scale.

FIG. 4 is an SEM photograph of a toner particle included in the toner A. FIG. 5 is an SEM photograph showing a part of FIG. 4 in enlarged scale. These SEM photographs (FIGS. 4 and 5) were captured by a scanning electron microscope (SEM) ("JSM-6700 F" manufactured by JEOL Ltd.).

As shown in FIG. 4, spherical toner particles were obtained. As shown in FIG. 5, the external additive was adhered to the surface of the toner mother particles.

The circularity of the toner A was 0.972. The following explains the method for measuring the circularity. First, 3 g of a surfactant (aqueous solution containing "Contaminon® N", which is manufactured by Wako Pure Chemical Industries, Ltd., at a concentration of 2% by mass) was added to 0.1 g of the toner A to obtain a mixture. Subsequently, the resultant mixture (of the toner mother particles and the surfactant) was exposed to ultrasonic irradiation to disperse the surfactant in the toner A. Thereafter, the mixture (of the toner A and the surfactant) was diluted with a sheath liquid ("Particle Sheath PSE-900A" manufactured by Sysmex Corporation). The circularity of the toner A in the mixture was measured using a flow particle image analyzer ("FPIA®-3000" manufactured by Sysmex Corporation).

The following now explains the preparation methods of the respective toners B to Q. Unless otherwise stated, the evaluation methods of the toners B to Q were the same as the evaluation method of the toner A.

[Preparation Method of Toner B]

The preparation method of the toner B was the same as the preparation method of the toner A in all aspects other than that the additive amount of the shell material A used in the shell layer formation was 1 mL instead of 2 mL. The circularity of the toner B was 0.976.

[Preparation Method of Toner C]

The preparation method of the toner C was the same as the preparation method of the toner A in all aspects other than that the additive amount of the shell material A used in the shell layer formation was 4 mL instead of 2 mL. The circularity of the toner C was 0.965.

[Preparation Method of Toner D]

The preparation method of the toner D was the same as the preparation method of the toner A in all aspects other than that the additive amount of the shell material A used in the shell layer formation was 0.5 mL instead of 2 mL. The circularity of the toner D was 0.978.

[Preparation Method of Toner E]

The preparation method of the toner E was the same as the preparation method of the toner A in all aspects other than that the additive amount of the shell material A used in the shell layer formation was 0.1 mL instead of 2 mL. The circularity of the toner E was 0.989.

[Preparation Method of Toner F]

The preparation method of the toner F was the same as the preparation method of the toner A in all aspects other than that the cores B were used instead of the cores A. The circularity of the toner F was 0.970.

The following explains the cores B. In the preparation of the cores B, the amount of ethylene oxide adduct (addition number) used to synthesize the polyester resin (binder resin of the cores B) was increased as compared with that used in the preparation of the cores A. The resultant polyester resin (binder resin of the cores B) had the hydroxyl group value (OHV value) of 10 mgKOH/g, the acid value (AV value) of 19 mgKOH/g, Tm of 98.2° C., and Tg of 50° C.

Subsequently, in the same manner as in the preparation of the cores A, 100 parts by mass of the above polyester resin was mixed with 5 parts by mass of a colorant (C.I. pigment blue 15:3) and 5 parts by mass of a releasing agent ("WEP-3" manufactured by NOF Corporation), followed by kneading of the resultant mixture, pulverization of the kneaded matter, and classification of the pulverized matter. Through the above, cores B having a median diameter (volume distribution standard) of 6.2 μm were obtained. The resultant cores B were anionic. The resultant cores B had the shape index (circularity) of 0.934, Tg of 43° C., and Tm of 89° C.

[Preparation Method of Toner G]

The preparation method of the toner G was the same as the preparation method of the toner F in all aspects other than that the additive amount of the shell material A used in the shell layer formation was 4 mL instead of 2 mL. The circularity of the toner G was 0.963.

[Preparation Method of Toner H]

The preparation method of the toner H was the same as the preparation method of the toner A in all aspects other than that the cores C were used instead of the cores A. The circularity of the toner H was 0.982.

The following explains the cores C. In the preparation of the cores C, bisphenol A-propylene oxide adduct (specifically, alcohol having bisphenol A as a framework to which propylene oxide is added) was reacted with a polyfunctional acid (specifically, para-phthalic acid) to prepare a polyester resin (binder resin of the cores C). The resultant polyester resin (binder resin of the cores C) had the hydroxyl group value (OHV value) of 9 mgKOH/g, the acid value (AV value) of 20 mgKOH/g, Tm of 98.6° C., and Tg of 50° C.

Subsequently, in the same manner as in the preparation of the cores A, 100 parts by mass of the above polyester resin was mixed with 5 parts by mass of a colorant (C.I. pigment blue 15:3) and 5 parts by mass of a releasing agent ("WEP-3" manufactured by NOF Corporation), followed by kneading of the resultant mixture, pulverization of the kneaded matter, and classification of the pulverized matter. Through the above, cores C having a median diameter (volume distribution standard) of 6.1 μm were obtained. The resultant cores C were anionic. The resultant cores C had the shape index (circularity) of 0.933, Tg of 42° C., and Tm of 88.6° C.

[Preparation Method of Toner I]

The preparation method of the toner I was the same as the preparation method of the toner H in all aspects other than that the additive amount of the shell material A used in the shell layer formation was 4 mL instead of 2 mL. The circularity of the toner I was 0.978.

[Preparation Method of Toner J]

The preparation method of the toner J was the same as the preparation method of the toner A in all aspects other than that the cores D were used instead of the cores A. The circularity of the toner J was 0.971.

The following explains the cores D. In the preparation of the cores D, the amount (compounding ratio) of the acid monomer used to synthesize the polyester resin (binder resin of the cores D) was increased to 1.2 times the amount used in the preparation of the cores A. The resultant polyester resin (binder resin of the cores D) had the hydroxyl group value (OHV value) of 9.2 mgKOH/g, the acid value (AV value) of 31 mgKOH/g, Tm of 99° C., and Tg of 50.1° C.

Subsequently, in the same manner as in the preparation of the cores A, 100 parts by mass of the above polyester resin was mixed with 5 parts by mass of a colorant (C.I. pigment blue 15:3) and 5 parts by mass of a releasing agent ("WEP-3" manufactured by NOF Corporation), followed by kneading of the resultant mixture, pulverization of the kneaded matter, and classification of the pulverized matter. Through the above, cores D having a median diameter (volume distribution standard) of 6.2 nm were obtained. The resultant cores D were anionic. The resultant cores D had the shape index (circularity) of 0.932, Tg of 45° C., and Tm of 89.2° C.

[Preparation Method of Toner K]

The preparation method of the toner K was the same as the preparation method of the toner J in all aspects other than that the additive amount of the shell material A used in the shell layer formation was 4 mL instead of 2 mL. The circularity of the toner K was 0.964.

[Preparation Method of Toner L]

The preparation method of the toner L was the same as the preparation method of the toner A in all aspects other than that the cores E were used instead of the cores A. The circularity of the toner L was 0.981.

The following explains the cores E. In the preparation of the cores E, the amount (compounding ratio) of the acid monomer used to synthesize the polyester resin (binder resin of the cores E) was decreased to 0.7 times the amount used in the preparation of the cores A. The resultant polyester resin (binder resin of the cores E) had the hydroxyl group value (OHV value) of 10 mgKOH/g, the acid value (AV value) of 9 mgKOH/g, Tm of 97° C., and Tg of 49.2° C.

Subsequently, in the same manner as in the preparation of the cores A, 100 parts by mass of the above polyester resin was mixed with 5 parts by mass of a colorant (C.I. pigment blue 15:3) and 5 parts by mass of a releasing agent ("WEP-3" manufactured by NOF Corporation), followed by kneading of the resultant mixture, pulverization of the kneaded matter, and classification of the pulverized matter. Through the above, cores E having a median diameter (volume distribution standard) of 6.1 μm were obtained. The resultant cores E were anionic. The resultant cores E had the shape index (circularity) of 0.931, Tg of 43.1° C., and Tm of 88.6° C.

[Preparation Method of Toner M]

The preparation method of the toner M was the same as the preparation method of the toner L in all aspects other than that the additive amount of the shell material A used in the shell layer formation was 4 mL instead of 2 mL. The circularity of the toner M was 0.979.

[Preparation Method of Toner N]

The preparation method of the toner N was the same as the preparation method of the toner A in all aspects other than that the cores B were used instead of the cores A. The circularity of the toner N was 0.970.

The shell material B was an aqueous solution of methylolated urea ("Mirben resin KAM-7" manufactured by Showa Denko K.K., solid concentration 80% by mass) with a miscibility of 200. The additive amount of the shell material B was 2 mL.

[Preparation Method of Toner O]

The preparation method of the toner O was the same as the preparation method of the toner N in all aspects other than that the additive amount of the shell material B used in the shell layer formation was 4 mL instead of 2 mL. The circularity of the toner O was 0.962.

[Preparation Method of Toner P]

The preparation method of the toner P was the same as the preparation method of the toner A in all aspects other than that the cores C were used instead of the cores A. The circularity of the toner P was 0.977.

The shell material C is an aqueous solution of methylol melamine ("Nikaresin S-260" manufactured by Nippon Carbide Industries Co., Inc., solid concentration 80% by mass) with a miscibility of 1,000. The additive amount of the shell material C used in the shell layer formation was 2 mL.

[Preparation Method of Toner Q]

The preparation method of the toner Q was the same as the preparation method of the toner P in all aspects other than that the additive amount of the shell material C used in the shell layer formation was 4 mL instead of 2 mL. The circularity of the toner Q was 0.970.

[Evaluation Method]

The following explains the evaluation method of each sample (toners A to Q).

(Core Coverage Ratio, Shell Length, and Shell Layer Thickness)

Figure 6:
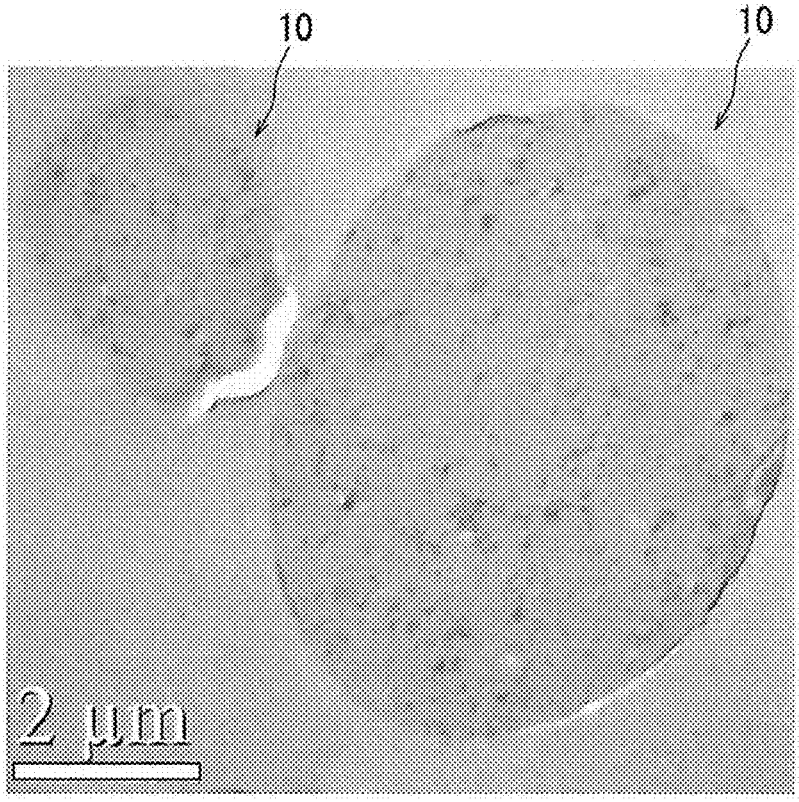
FIG. 6 is a TEM photograph showing an exemplary cross section of a sample in Example according to the present disclosure.

Each sample (toner) was dispersed in a cold setting epoxy resin and left to harden for two days at an ambient temperature of 40° C. to yield a hardened material. The hardened material was dyed in osmium tetroxide and subsequently a flake sample of 200 nm in thickness was cut therefrom using a ultra-microtome ("EM UC6" manufactured by Leica Microsystems) equipped with a diamond knife. Then, a cross-sectional image of the sample was captured using a field emission type transmission electron microscope (TEM) ("JEM-2100F" manufactured by JEOL Ltd.) with an accelerating voltage of 200 kV. FIG. 6 is a TEM photograph showing an exemplary cross section of the sample (cross sections of toner particles 10) in Example according to the present disclosure. Measurement targets were determined from among the aforementioned sample by randomly selecting 100 of the toner particles 10 captured in TEM images. However, among the cross sections imaged using TEM (i.e., cross sections of the toner particles 10), cross sections having a major axis (i.e., a largest diameter) of less than 3 μm were excluded from being measurement targets.

Next, each captured TEM image was analyzed using an electron energy loss spectrometer ("GIF TRIDEM®" manufactured by Gatan, Inc.), having an energy resolution of 1.0 eV and a beam diameter of 1.0 nm, and image-analyzing software ("WinROOF 5.5.0" provided by Mitani Corporation). More specifically, an EELS intensity map was generated for atoms (carbon, oxygen, nitrogen, and sulfur) contained in the shell layer.

Each pixel of the image (captured TEM image) was a 5 nm square.

Figure 7:
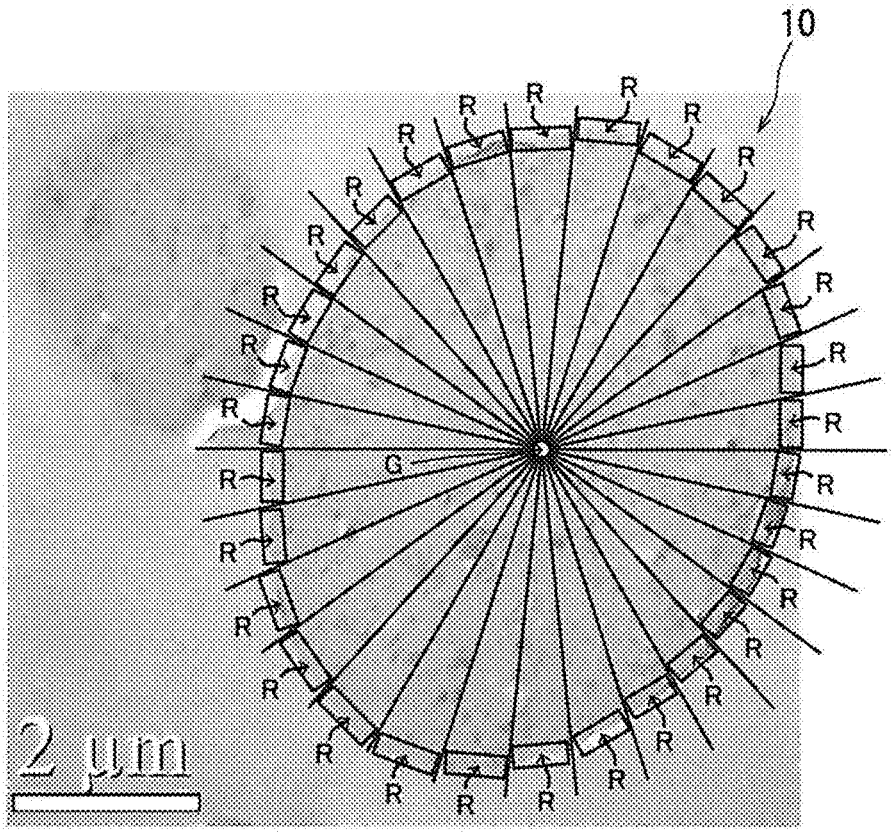
FIG. 7 illustrates a method for generating an EELS intensity map (mapping) in Example of the present disclosure.
Figure 8:
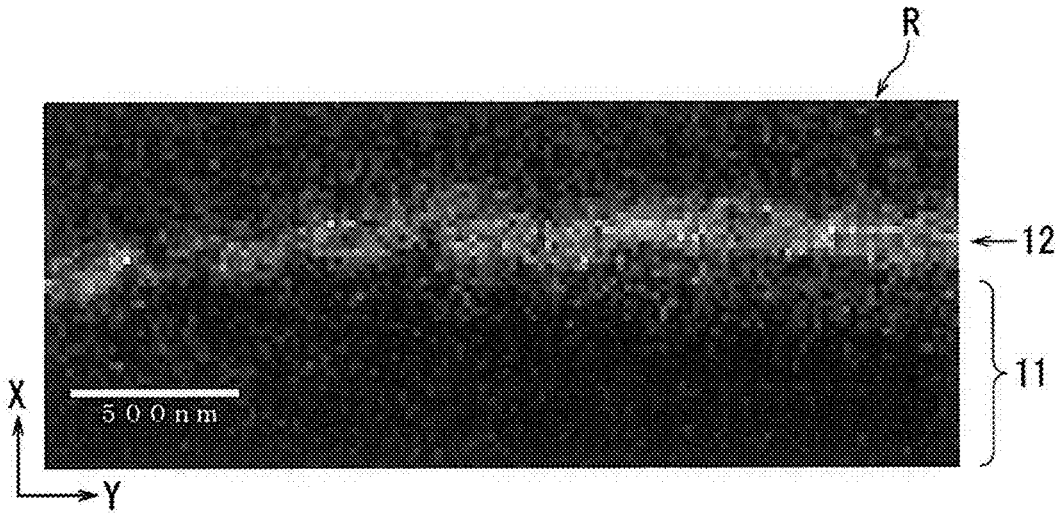
FIG. 8 illustrates an exemplary EELS intensity mapping image in Example of the present disclosure.

The following explains generation of the EELS intensity map (mapping) with reference mainly to FIGS. 7 and 8.

First, the image-analyzing software (WinROOF) was used to identify a center of mass G of the toner particle 10 as illustrated in FIG. 7. Next, lines were extended radially from the center of mass G, thereby partitioning the surface of the toner particle 10 into 30 regions R. Mapping was subsequently performed for carbon, oxygen, nitrogen, and sulfur with respect to each of the partitions (regions R) using the electron energy loss spectrometer.

FIG. 8 illustrates an example of a mapping image in which an EELS intensity map has been generated for the region R. The region R had a length of 500 pixels in a Y-direction which corresponds to a circumferential direction of the toner particle 10.

In the mapping image generated using the image-analyzing software (WinROOF), the EELS intensity was proportional to whiteness of the mapping image. Image density division was performed using a density calibration function of the image-analyzing software (WinROOF). More specifically, image densities were divided into 256 different values by determining a whitest section to have a value of 255 and a blackest section to have a value of 0.

The cross section of the toner particle 10 was analyzed by EELS to detect portions of the shell layer 12 each satisfying both the conditions (1) and (2) shown below:

(1) A ratio INc/INs, which is the ratio of INc of an N-K shell absorption-edge originating from nitrogen atoms in the core 11 to INs of an N-K shell absorption-edge originating from nitrogen atoms in the shell layer 12, is no less than 0.0 and no greater than 0.2; and (2) Thickness of the shell layer 12 is at least 5 nm.

During the aforementioned detection, the EELS intensity of the N-K shell absorption-edge originating from nitrogen atoms in the core 11 was measured in the region R. The following explains a method for measuring the EELS intensity of the core 11 with reference mainly to FIGS. 9 and 10.

Figure 9:
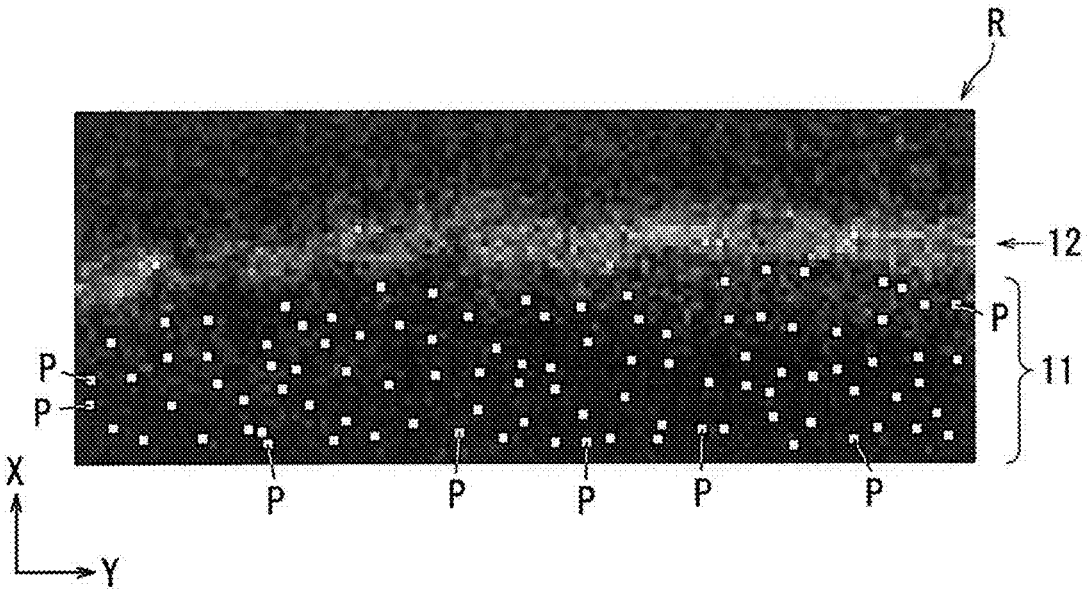
FIG. 9 illustrates a method for measuring EELS intensity of a core in Example of the present disclosure.

First, 100 positions in a region of the mapping image corresponding to the core 11 were randomly selected as measurement positions P as illustrated in FIG. 9. Next, the EELS intensity was measured at each of the 100 selected measurement positions P. The EELS intensity was measured on a 256-value scale. As illustrated in FIG. 10, subsequently an average value was calculated for the 100 EELS intensities measured as described above. More specifically, the EELS intensity of an N-K shell absorption-edge originating from nitrogen atoms in the core 11 was measured for each of the 100 measurement positions P. The average value for the 100 EELS intensities that were measured was determined to be the intensity INc (i.e., the value used for evaluation).

In order to satisfy the condition (1), INs must be at least five times as large as INc (i.e., INc×5≤INs). For example, when INc is 6.8 for a given pixel, the pixel satisfies the condition (1) if INs is at least 34 (=6.8×5). As explained above, each of the pixels is a 5 nm square in the image. Therefore, the shell layer 12 was determined to have a thickness of at least 5 nm (i.e., satisfying the condition (2)) when at least one pixel corresponding to the shell layer 12 satisfying the condition (1) was present at the surface of the core 11.

Next, the EELS intensity (INs) of an N-K shell absorption-edge originating from nitrogen atoms in the shell layer 12 was measured in the region R in order to detect the shell layer 12 satisfying the conditions (1) and (2). More specifically, a binarization function of the image-analyzing software (WinROOF) was used to identify pixels in the image (captured TEM image) as corresponding to the shell layer 12 satisfying the condition (1). As explained above, the condition (2) was determined to be satisfied so long as at least one pixel was identified as corresponding to the shell layer 12 satisfying the condition (1).

Next, the length of the shell layer 12 satisfying the conditions (1) and (2) in region R (more specifically, at the surface of the core 11) was measured. The following explains a method for measuring the length of the shell layer 12 with reference mainly to FIG. 11.

Figure 11:
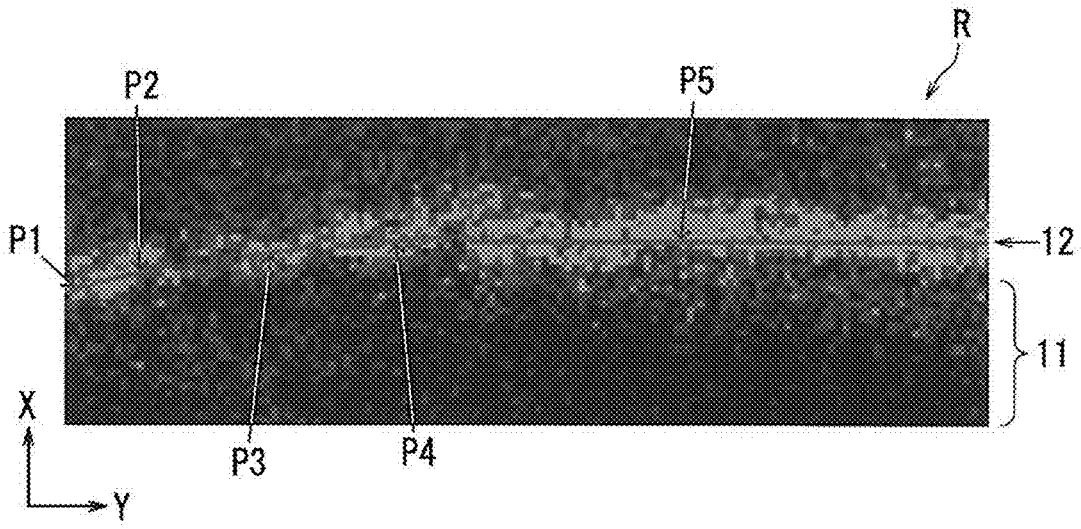
FIG. 11 illustrates a method for measuring the length of a shell layer in Example of the present disclosure.

The length of the shell layer 12 was measured using a measurement function (manual measurement function and line length measurement function) of the image-analyzing software (WinROOF). More specifically, as illustrated in FIG. 11, the image-analyzing software (WinROOF) converted the shell layer 12 into lines P1 to P5, and calculated the length of each of the lines P1 to P5 and the total length of the lines P1 to P5. The following measurement values were obtained in an example of the aforementioned measurement.

Length of line P1: 10.466 pixels
Length of line P2: 41.254 pixels
Length of line P3: 33.494 pixels
Length of line P4: 57.154 pixels
Length of line P5: 276.344 pixels
Total length of lines P1 to P5: approximately 419 pixels Next, a proportion of the surface area of the core 11 that was covered by the shell layer 12 satisfying the conditions (1) and (2) (i.e., a coverage ratio of the core 11) was calculated for the region R. Specifically, the aforementioned calculation was performed by dividing the total length (i.e., the number of pixels) of the shell layer 12 satisfying the conditions (1) and (2) by 500 pixels. Note that 500 pixels is equivalent to the length of the region R in the Y-direction (circumferential direction of the toner particle 10). In the example shown above, the total length of the lines P1 to P5 was approximately 419 pixels, and thus the coverage ratio of the core 11 was 83.8% (=419×100/500).

Next, a proportion of the surface of the core 11 covered by one or more portions of the shell layer 12 each satisfying the conditions (1) and (2) (hereinafter, referred to as a coverage ratio Rn) was calculated for the entire circumference of the core 11. In addition, the longest length among the one or more portions of the shell layer 12 each satisfying the conditions (1) and (2) (hereinafter, referred to as a longest length Ln) was determined.

Figure 13A:
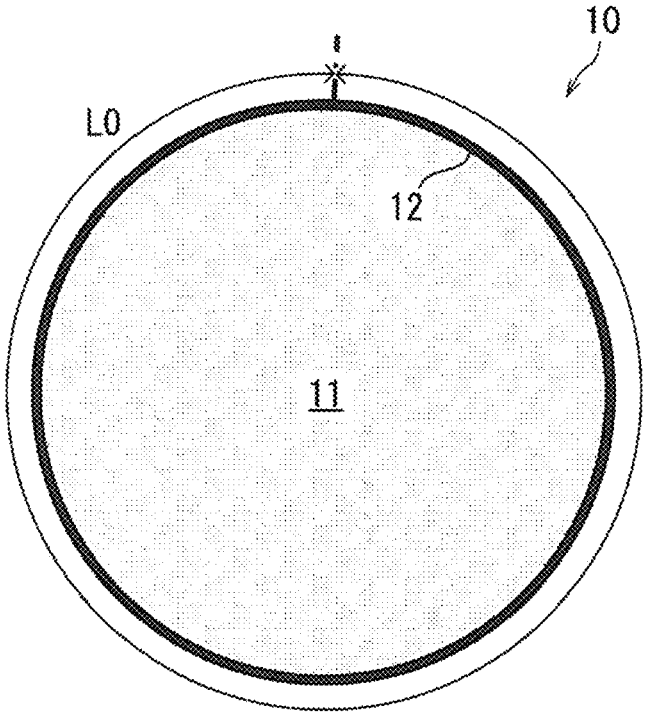
FIG. 13A illustrates the method for calculating a coverage ratio of a core in Example of the present disclosure.
Figure 13B:
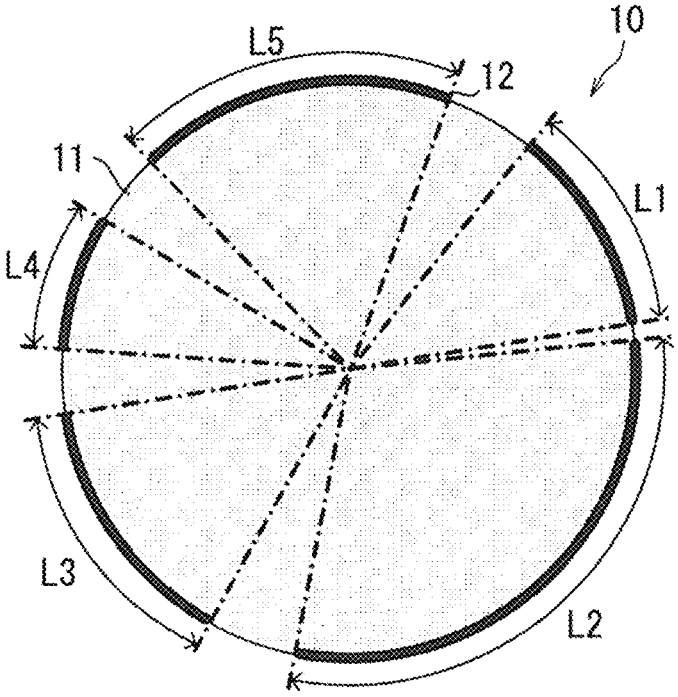
FIG. 13B illustrates the method for calculating a coverage ratio of a core in Example of the present disclosure.

The following explains a method for calculating the coverage ratio Rn with reference mainly to FIGS. 12, 13A, and 13B.

As illustrated in FIG. 12, a coverage ratio of the core 11 was calculated for each of the 30 regions R resulting from partitioning (refer to FIG. 7) in the same way as explained above. An average value of the 30 coverage ratios obtained through the above calculation was determined to be the coverage ratio Rn. In addition, of the shell layer 12 included in one toner particle 10, the length of each portion of the shell layer 12 satisfying the conditions (1) and (2) was calculated and the longest one of the thus calculated lengths was determined to be the longest length Ln.

FIG. 13A illustrates an example in which the coverage ratio Rn of the toner particle 10 is 100%. In FIG. 13A, length L0 indicates the circumferential length of the cross section of the toner particle 10.

FIG. 13B illustrates an example in which the core 11 of the toner particle 10 is covered only partially by portions of the shell layer 12 each satisfying the conditions (1) and (2). In FIG. 13B, lengths L1 to L5 indicate the lengths of the respective portions of the shell layer 12 each satisfying the conditions (1) and (2). The coverage ratio Rn was calculated by dividing the total of the lengths L1 to L5 by the length L0. Thus, the coverage ratio Rn was calculated based on an expression: Rn=100×(L1+L2+L3+L4+L5)/L0. In FIG. 13B, in addition, the longest one of the lengths L1 to L5 (length L2 in this example) is the longest length Ln.

The coverage ratio Rn and the longest length Ln were measured for each of the 100 toner particles 10 included in the sample (toner). Evaluation values of the coverage ratio Rn and the longest length Ln were determined by calculating 100 relevant measurement values. Then, each sample (toner) was evaluated as to whether or not the conditions (3) and (4) shown below were satisfied:

(3) The coverage ratio Rn (evaluation value) was at least 50%; and (4) The longest length Ln (evaluation value) was at least 100 nm.

In addition, the thickness of the shell layer 12 was calculated from the number of pixels (corresponding to the shell layer 12) satisfying the condition (1). The direction of the thickness of the shell layer 12 corresponds to the direction of a straight line connecting the center of mass Ga of the toner particle 10 to a point where a pixel (corresponding to the shell layer 12) satisfying the condition (1) is in contact with the surface of the core 11 (see FIG. 7). As explained above, each of the pixels is a 5 nm square in the image. For example, when two pixels (corresponding to the shell layer 12) satisfying the condition (1) are contiguous from the surface of the core 11 in the thickness direction of the shell layer 12, the thickness of the shell layer 12 is determined to be 10 nm. The greatest thickness among the portions of the shell layer 12 of one toner particle 10 (hereinafter, a greatest thickness Tn) was determined. The greatest thickness Tn was measured for each of the 100 toner particles 10 and the average of the 100 measurement values was taken as the evaluation value.

(Fixability)

A color printer altered such that the fixing temperature by a roller-roller type heat pressure fixing unit (nip width: 8 mm) was adjustable (an alteration of "FS-C5250DN" manufactured by KYOCERA Document Solutions Inc.) was used as an evaluation device. A two-component developer was prepared by mixing 100 parts by mass of a developer carrier (carrier for FS-05250DN) and 10 parts by mass of the sample (toner) for 30 minutes using a ball mill. The two-component developer thus prepared was put into a developing device for the color cyan of the evaluation device, whereas the sample (toner) was put into the toner container for the color cyan of the evaluation device.

By the evaluation device, 90 g/m$^2$ of a sheet of paper was conveyed at a linear velocity of 200 mm, and 1.0 m g/cm$^2$ of the toner was developed on the paper being conveyed. Note that the image formed with the toner was a solid image. Subsequently, the sheet of paper on which the image was developed was passed through the fixing unit. The time taken to pass thorough the nip was 40 msec. The setting range of the fixing temperature was from 100° C. to 200° C. Specifically, the fixing temperature of the fixing unit was raised from 100° C. by a 5° C. increment to determine the lowest temperature at which the toner was fixed to the paper without causing offset of the toner (solid image). Occurrence of offset was visually checked.

The lowest fixing temperature of no greater than 165° C. was evaluated as "Good", and the lowest fixing temperature exceeding 165° C. was evaluated as "Poor".

(High-Temperature Preservability)

First, 3 g of the sample (toner) was put into a 20 ml plastic vessel and left to stand for 3 hours in a constant temperature chamber maintained at 60° C. Through the above, an evaluation toner was obtained. Subsequently, the evaluation toner was sifted through a 100-mesh sieve (opening: 150 μm) placed on a powder tester, for 30 seconds and at the vibration level 5. The mass of the toner remaining on the sieve after the sifting was measured. From the mass of the toner before the sifting and the mass of the toner after the sifting (toner remaining on the sieve after the sifting), the aggregation rate (% by mass) was calculated using the following expression.

Aggregation rate (% by mass)=(Mass of Toner after Sifting/Mass of Toner before Sifting)×100

The aggregation rate of no greater than 20% by mass was evaluated as "Good", and the aggregation rate exceeding 20% by mass was evaluated as "Poor".

[Evaluation Results]

Table 2 shows the evaluation results of the respective samples (toners A to Q).

TABLE 2

| Toner | Shell Layer: Greatest Thickness [nm] | Shell Layer: Coverage Ratio [%] | Shell Layer: Longest Length [nm] | High-Temperature Preservability [% by mass] | Lowest Fixing Temperature [° C.] |
|---|---|---|---|---|---|
| Toner A | 10 | 78 | 635 | 10 | 150 |
| Toner B | 10 | 69 | 365 | 15 | 140 |
| Toner C | 15 | 85 | 1,035 | 3 | 160 |
| Toner D | 5 | 54 | 110 | 20 | 140 |
| Toner E | 5 | 6 | 40 | 99 | 120 |
| Toner F | 10 | 82 | 670 | 8 | 155 |
| Toner G | 15 | 89 | 1,100 | 2 | 165 |
| Toner H | 5 | 23 | 130 | 62 | 140 |
| Toner I | 5 | 32 | 250 | 45 | 150 |
| Toner J | 10 | 81 | 620 | 15 | 155 |
| Toner K | 15 | 87 | 900 | 12 | 165 |
| Toner L | 15 | 35 | 45 | 63 | 150 |
| Toner M | 20 | 42 | 105 | 47 | 160 |
| Toner N | 10 | 86 | 755 | 7 | 150 |
| Toner O | 15 | 91 | 1,215 | 2 | 160 |
| Toner P | 5 | 40 | 55 | 55 | 150 |
| Toner Q | 10 | 50 | 85 | 45 | 155 |

Toners A to D, F, G, J, K, N, and O (respectively corresponding to Examples 1 to 10) each satisfied both the conditions (3) and (4). Specifically, in a cross section of a toner particle analyzed by EELS, each of the toners A to D, F, G, J, K, N, and O was such that: the coverage ratio Rn (the proportion of the circumferential length of the core covered by one or more portions of a shell layer each satisfying the conditions that: (1) the ratio of INc to INs was no less than 0.0 and no greater than 0.2; and (2) the thickness of the shell layer was at least 5 nm) was at least 50% of the circumferential length of the core; and the longest length Ln (the longest length among one or more portions of a shell layer each satisfying the conditions (1) and (2)) was at least 100 nm Note that INs indicates the intensity of an N-K shell absorption-edge originating from nitrogen atoms in the shell layer, whereas INc indicates the intensity of an N-K shell absorption-edge originating from nitrogen atoms in the core.

The toners H, I, and M (respectively corresponding to Comparative Examples 2, 3, and 5) failed to satisfy the condition (3) but satisfied the condition (4).

The toner Q (corresponding to Comparative Example 7) failed to satisfy the condition (4) but satisfied the condition (3).

The toners E, L, and P (respectively corresponding to Comparative Examples 1, 4, and 6) failed to satisfy either the condition (3) or (4).

The toner E (corresponding to Comparative Example 1) resulted in the coverage ratio Rn (evaluation value) of 6%, which means that substantially no shell layers were formed to cover the cores. This is assumed to be because the additive amount of the shell material used in the preparation method of the toner E was small.

The toners H and I (respectively corresponding to Comparative Examples 2 and 3) each resulted in the coverage ratio (evaluation value) of less than 50%. In the preparation method of the toners H and I, the polyester resin (the binder resin of the cores C) was synthesized using bisphenol A-propylene oxide adduct, and propylene oxide was assumed to have caused steric hindrance to prevent the shell material from adhering to the surface of the cores.

The toners L and M (respectively corresponding to Comparative Examples 4 and 5) each resulted in the coverage ratio (evaluation value) of less than 50%. This is assumed to be because the acid value (AV value) of the cores E used in the preparation of the respective toners L and M was small and thus the binding site for the shell material was limited on the surface of the cores E.

With regards to the toners P and Q (corresponding to Comparative Examples 6 and 7), the longest length Ln (evaluation value) was less than 100 nm. The shell material C used to prepare the respective toners P and Q had high miscibility and thus had high affinity for water. This restricted adhesion of the shell material C to the surface of the cores.

As for the fixability, the toners A to Q all exhibited the lowest fixing temperature of no greater than 165° C.

As for the high-temperature preservability, the aggregation rate was no greater than 20% by mass for the toners A to D, F, G, J, K, N, and O (toners corresponding to Examples 1 to 10), and exceeding 20% by mass (more specifically, exceeding 40% by mass) for the toners E, H, I, L, M, P, and Q (toners corresponding to Comparative Examples 1 to 7).

As has been described above, for the toners A to D, F, U, J, K, N, and O, the lowest fixing temperature was no greater than 165° C. and the aggregation rate was no greater than 20% by mass. The toners A to D, F, G, J, K, N, and O all had excellent high-temperature preservability and excellent low-temperature fixability.

As shown in Table 2, in addition, for the toners A, B, F, J, and N (respectively corresponding to Examples 1, 2, 5, 7, and 9), the lowest fixing temperature was no greater than 155° C. and the aggregation rate was no greater than 15% by mass. The toners A, B, F, J, and N all had excellent high-temperature preservability and excellent low-temperature fixability. For the toners A, B, F, J, and N, the coverage ratio Rn (evaluation value) was no less than 65% and no greater than 86%, and the longest length Ln (evaluation value) was no less than 350 nm and no greater than 1,000 nm.

For the toners A to D, F, G, J, K, N, and O, the greatest thickness Tn (evaluation value) was no less than 5 nm and no greater than 15 nm. In addition, the cores were anionic, and the shell layers were cationic. Also, the shell layers contained a thermosetting resin.

The present disclosure is not limited to the specific examples described above. The toner has excellent high-temperature preservability and excellent low-temperature fixability as long as the coverage ratio Rn is at least 50% and the longest length Ln is at least 100 nm.

What is claimed is:

1. A toner comprising:

a plurality of toner particles each having a core, and a shell layer on a surface of the core, wherein the shell layer contains a urea resin, the toner particles have an average circularity of no less than 0.962 and no greater than 0.978, and in a cross section of the toner particle analyzed by EELS, for at least 50% of a circumferential length of the core, the shell layer has one or more portions each satisfying conditions that a ratio of INc to INs is no less than 0.0 and no greater than 0.2, and a thickness of the shell layer is at least 5 nm, a longest length among the one or more portions of the shell layer each satisfying the conditions is at least 100 nm, and a greatest thickness among the one or more portions of the shell layer each satisfying the conditions is no less than 5 nm and no greater than 15 nm, where INs indicates an intensity of an N-K shell absorption-edge originating from nitrogen atoms in the shell layer, and INc indicates an intensity of an N-K shell absorption-edge originating from nitrogen atoms in the core.

2. A toner according to claim 1, wherein for no less than 65% and no greater than 86% of the circumferential length of the core, the shell layer has the one or more portions each satisfying the conditions, and a longest length among the one or more portions of the shell layer each satisfying the conditions is no less than 350 nm and no greater than 1,000 nm.

3. A toner according to claim 1, wherein the core contains a polyester resin.

* * * * *